US010711645B2

(12) United States Patent
James

(10) Patent No.: US 10,711,645 B2
(45) Date of Patent: Jul. 14, 2020

(54) MULTIPLE RESERVOIR LUBRICATION SYSTEM

(71) Applicant: United Technologies Corporation, Farmington, CT (US)

(72) Inventor: Denman H. James, Windsor, CT (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 212 days.

(21) Appl. No.: 15/709,663

(22) Filed: Sep. 20, 2017

(65) Prior Publication Data

US 2018/0003082 A1 Jan. 4, 2018

Related U.S. Application Data

(63) Continuation of application No. 13/630,205, filed on Sep. 28, 2012, now abandoned.

(51) Int. Cl.
*F01D 25/20* (2006.01)
*F01M 11/06* (2006.01)

(52) U.S. Cl.
CPC ..... *F01D 25/20* (2013.01); *F01M 11/067* (2013.01); *F05D 2260/98* (2013.01)

(58) Field of Classification Search
CPC ... F01D 25/20; F05D 2260/98; F01M 11/067; B64D 37/22
See application file for complete search history.

(56) References Cited

U.S. PATENT DOCUMENTS 2,570,698 A 10/1951 Manseau
2,830,668 A 4/1958 Gaubis et al.
4,117,907 A * 10/1978 Lechler ..... F01M 11/067 123/196 CP
4,511,016 A 4/1985 Döëll
4,717,000 A 1/1988 Waddington et al.
4,891,934 A 1/1990 Huelster
4,899,850 A 2/1990 Köller et al.
4,917,218 A 4/1990 Murray
4,976,335 A 12/1990 Cappellato
6,463,819 B1 10/2002 Rago
6,793,042 B2 9/2004 Brouillet
(Continued)

OTHER PUBLICATIONS

International Search Report and Written Opinion for PCT Application No. PCT/US2013/061096 dated Dec. 17, 2013.
(Continued)

*Primary Examiner* — Minh Truong
(74) *Attorney, Agent, or Firm* — Carlson, Gaskey & Olds, P.C.

(57) ABSTRACT

A lubrication system for use with a gas turbine engine includes a first reservoir for containing a lubricant. The first reservoir includes a first discharge passage through which the lubricant is flowable in a first direction. A second reservoir contains the lubricant. The second reservoir includes a second discharge passage through which the lubricant is flowable in a second direction. The first direction is generally opposite to the second direction. A first pump pumps the lubricant from the first reservoir. A second pump pumps the lubricant from the second reservoir. A manifold distributes the lubricant to a component. The lubricant from the first pump and the second pump flows into the manifold and exits the manifold through a manifold discharge.

11 Claims, 2 Drawing Sheets

(56) References Cited

U.S. PATENT DOCUMENTS

| | | | | |
|---|---|---|---|---|
| 6,886,324 | B1 | 5/2005 | Handshuh et al. | |
| 7,093,418 | B2 | 8/2006 | Morris et al. | |
| 7,225,626 | B2 | 6/2007 | Robinson et al. | |
| 7,493,753 | B2 | 2/2009 | Moniz et al. | |
| 8,181,746 | B2 | 5/2012 | Szolomayer et al. | |
| 8,307,626 | B2 | 11/2012 | Sheridan | |
| 8,517,148 | B2 | 8/2013 | Portlock et al. | |
| 2006/0249332 | A1 | 11/2006 | Bruce | |
| 2007/0039782 | A1 | 2/2007 | Bedford | |
| 2008/0093173 | A1 | 4/2008 | James et al. | |
| 2008/0127627 | A1 | 6/2008 | Jewess et al. | |
| 2009/0057060 | A1 | 3/2009 | Jones | |
| 2010/0126589 | A1 | 5/2010 | Angst | |
| 2010/0294371 | A1 | 11/2010 | Parnin et al. | |
| 2010/0294597 | A1 | 11/2010 | Parnin | |
| 2014/0026534 | A1* | 1/2014 | Homeyer | F01D 21/00 60/39.08 |
| 2014/0090930 | A1* | 4/2014 | James | F01D 25/20 184/6.11 |
| 2019/0218936 | A1* | 7/2019 | Fomison | F01D 25/162 |

OTHER PUBLICATIONS

International Preliminary Report on Patentability for PCT Application No. PCT/US2013/061096, dated Apr. 9, 2015.

* cited by examiner

MULTIPLE RESERVOIR LUBRICATION SYSTEM

CROSS-REFERENCE TO RELATED APPLICATION

This application is a continuation of U.S. application Ser. No. 13/630,205 filed on Sep. 28, 2012.

BACKGROUND OF THE INVENTION

Some areas of a gas turbine engine require uninterrupted lubrication during engine operation. Example areas are bearings, such as rolling element bearings or journal bearings, or gears used throughout the engine and engine accessories. Lubricant is stored in a reservoir.

A sudden change in attitude of the engine could move the lubricant in the reservoir, moving the lubricant away from a discharge passage. If this occurs, there could be an interruption in the supply of lubricant to the lubricated components.

SUMMARY OF THE INVENTION

A lubrication system for use with a gas turbine engine according to an exemplary embodiment of this disclosure, among other possible things includes, a first reservoir for containing a lubricant. The first reservoir includes a first discharge passage through which the lubricant is flowable in a first direction. A second reservoir contains the lubricant. The second reservoir includes a second discharge passage through which the lubricant is flowable in a second direction. The first direction is generally opposite to the second direction. A first pump pumps the lubricant from the first reservoir. A second pump pumps the lubricant from the second reservoir. A manifold distributes the lubricant to a component. The lubricant from the first pump and the second pump flows into the manifold and exits the manifold through a manifold discharge.

In a further embodiment of any of the foregoing lubrication systems, the component is a bearing.

In a further embodiment of any of the foregoing lubrication systems, the component is a fan journal bearing of a gas turbine engine.

In a further embodiment of any of the foregoing lubrication systems, the first direction is substantially upwardly and the second direction is substantially downwardly.

In a further embodiment of any of the foregoing lubrication systems, an output of each of the first pump and the second pump is greater than a lubrication requirement of the component.

In a further embodiment of any of the foregoing lubrication systems, the lubricant flows directly from the manifold discharge of the manifold to the component.

In a further embodiment of any of the foregoing lubrication systems, includes a valve. The lubricant flows from the manifold discharge of the manifold to the valve.

In a further embodiment of any of the foregoing lubrication systems, the valve is a relief valve.

In a further embodiment of any of the foregoing lubrication systems, the valve directs a portion of the lubricant to the component and a remainder of the lubricant to at least one of the first reservoir and the second reservoir.

In a further embodiment of any of the foregoing lubrication systems, the valve closes if one of the first reservoir or the second reservoir is empty.

In a further embodiment of any of the foregoing lubrication systems, the valve is a control valve. The lubrication system includes a sensor associated with each of the first reservoir and the second reservoir that detects an amount of the lubricant in each of the first reservoir and the second reservoir. The control valve directs the lubricant to the one of the first reservoir and the second reservoir if one of the sensors detects that the one of the first reservoir and the second reservoir is depleted of the lubricant.

A lubrication system for use with a gas turbine engine according to an exemplary embodiment of this disclosure, among other possible things includes, a first reservoir for containing a lubricant. The first reservoir includes a first discharge passage through which the lubricant is flowable in a first direction. A second reservoir contains a lubricant. The second reservoir includes a second discharge passage through which the lubricant is flowable in a second direction. The first direction is opposite to the second direction. A first pump pumps the lubricant from the first reservoir. A second pump pumps the lubricant from the second reservoir. A manifold distributes the lubricant to a bearing. The lubricant from the first pump and the second pump flows into the manifold and exits the manifold through a manifold discharge, and a valve. The lubricant flows from the manifold discharge of the manifold to the valve.

In a further embodiment of any of the foregoing lubrication system, the component is a fan journal bearing of a gas turbine engine.

In a further embodiment of any of the foregoing lubrication systems, the first direction is substantially upwardly and the second direction is substantially downwardly.

In a further embodiment of any of the foregoing lubrication systems, an output of each of the first pump and the second pump is greater than a lubrication requirement of the component.

In a further embodiment of any of the foregoing lubrication systems, the valve is a relief valve.

In a further embodiment of any of the foregoing lubrication systems, the valve directs a portion of the lubricant to the component and a remainder of the lubricant to at least one of the first reservoir and the second reservoir.

In a further embodiment of any of the foregoing lubrication systems, the valve closes if one of the first reservoir or the second reservoir is empty.

In a further embodiment of any of the foregoing lubrication systems, the valve is a control valve. The lubrication system includes a sensor associated with each of the first reservoir and the second reservoir that detects an amount of the lubricant in each of the first reservoir and the second reservoir. The control valve directs the lubricant to the one of the first reservoir and the second reservoir if one of the sensors detects that the one of the first reservoir and the second reservoir is depleted of the lubricant.

These and other features of the present invention can be best understood from the following specification and drawings, the following of which is a brief description.

DETAILED DESCRIPTION OF THE PREFERRED EMBODIMENTS

Figure 1:
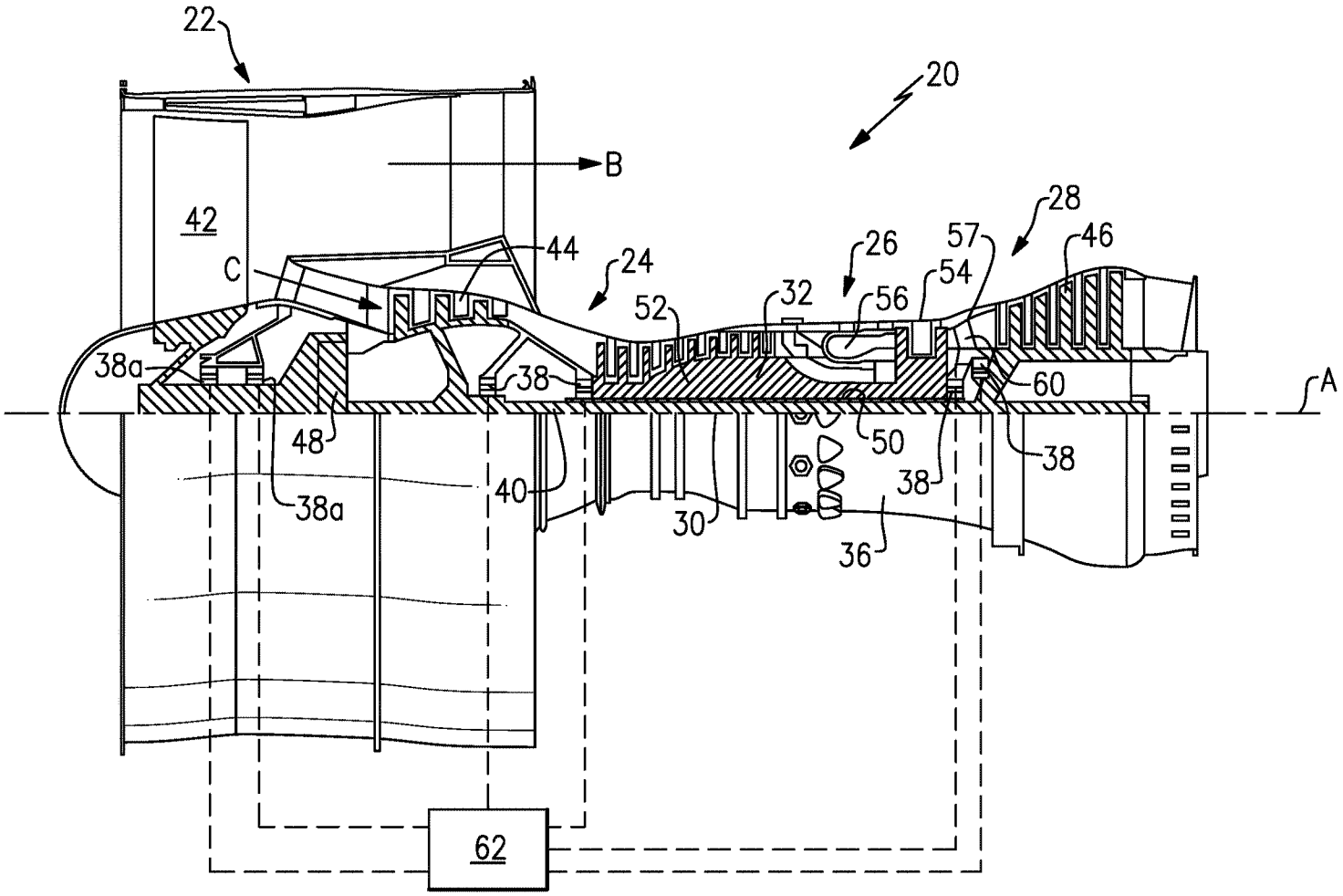
FIG. 1 illustrates a schematic view of an embodiment of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features.

Although depicted as a turbofan gas turbine engine in the disclosed non-limiting embodiment, it should be understood that the concepts described herein are not limited to use with turbofans as the teachings may be applied to other types of turbine engines including three-spool or geared turbofan architectures.

The fan section 22 drives air along a bypass flowpath B while the compressor section 24 drives air along a core flowpath C for compression and communication into the combustor section 26 then expansion through the turbine section 28.

The gas turbine engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided. For example, the bearing system 38 also includes fan journal bearings 38*a*.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and a high pressure turbine 54.

A combustor 56 is arranged between the high pressure compressor 52 and the high pressure turbine 54.

A mid-turbine frame 58 of the engine static structure 36 is arranged generally between the high pressure turbine 54 and the low pressure turbine 46. The mid-turbine frame 58 further supports bearing systems 38 in the turbine section 28.

The inner shaft 40 and the outer shaft 50 are concentric and rotate via bearing systems 38 about the engine central longitudinal axis A, which is collinear with their longitudinal axes.

The core airflow C is compressed by the low pressure compressor 44, then the high pressure compressor 52, mixed and burned with fuel in the combustor 56, then expanded over the high pressure turbine 54 and low pressure turbine 46. The mid-turbine frame 58 includes airfoils 60 which are in the core airflow path. The turbines 46, 54 rotationally drive the respective low speed spool 30 and high speed spool 32 in response to the expansion.

The gas turbine engine 20 is in one example a high-bypass geared aircraft engine. In a further example, the gas turbine engine 20 bypass ratio is greater than about six (6:1) with an example embodiment being greater than ten (10:1). The geared architecture 48 is an epicyclic gear train (such as a planetary gear system or other gear system) with a gear reduction ratio of greater than about 2.3 (2.3:1). The low pressure turbine 46 has a pressure ratio that is greater than about five (5:1). The low pressure turbine 46 pressure ratio is pressure measured prior to inlet of low pressure turbine 46 as related to the pressure at the outlet of the low pressure turbine 46 prior to an exhaust nozzle.

In one disclosed embodiment, the gas turbine engine 20 bypass ratio is greater than about ten (10:1), and the fan diameter is significantly larger than that of the low pressure compressor 44. The low pressure turbine 46 has a pressure ratio that is greater than about five (5:1). The geared architecture 48 may be an epicycle gear train, such as a planetary gear system or other gear system, with a gear reduction ratio of greater than about 2.5 (2.5:1). It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the gas turbine engine 20 is designed for a particular flight condition—typically cruise at about 0.8 Mach and about 35,000 feet. The flight condition of 0.8 Mach and 35,000 feet, with the engine at its best fuel consumption, also known as bucket cruise Thrust Specific Fuel Consumption ("TSFC"). TSFC is the industry standard parameter of lbm of fuel being burned divided by lbf of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.45.

"Low corrected fan tip speed" is the actual fan tip speed in feet per second divided by an industry standard temperature correction of $[(\text{Tram}\ ^\circ\ \text{R})/518.7)^{0.5}]$. The "Low corrected fan tip speed" as disclosed herein according to one non-limiting embodiment is less than about 1150 feet per second (351 meters per second).

Figure 2:
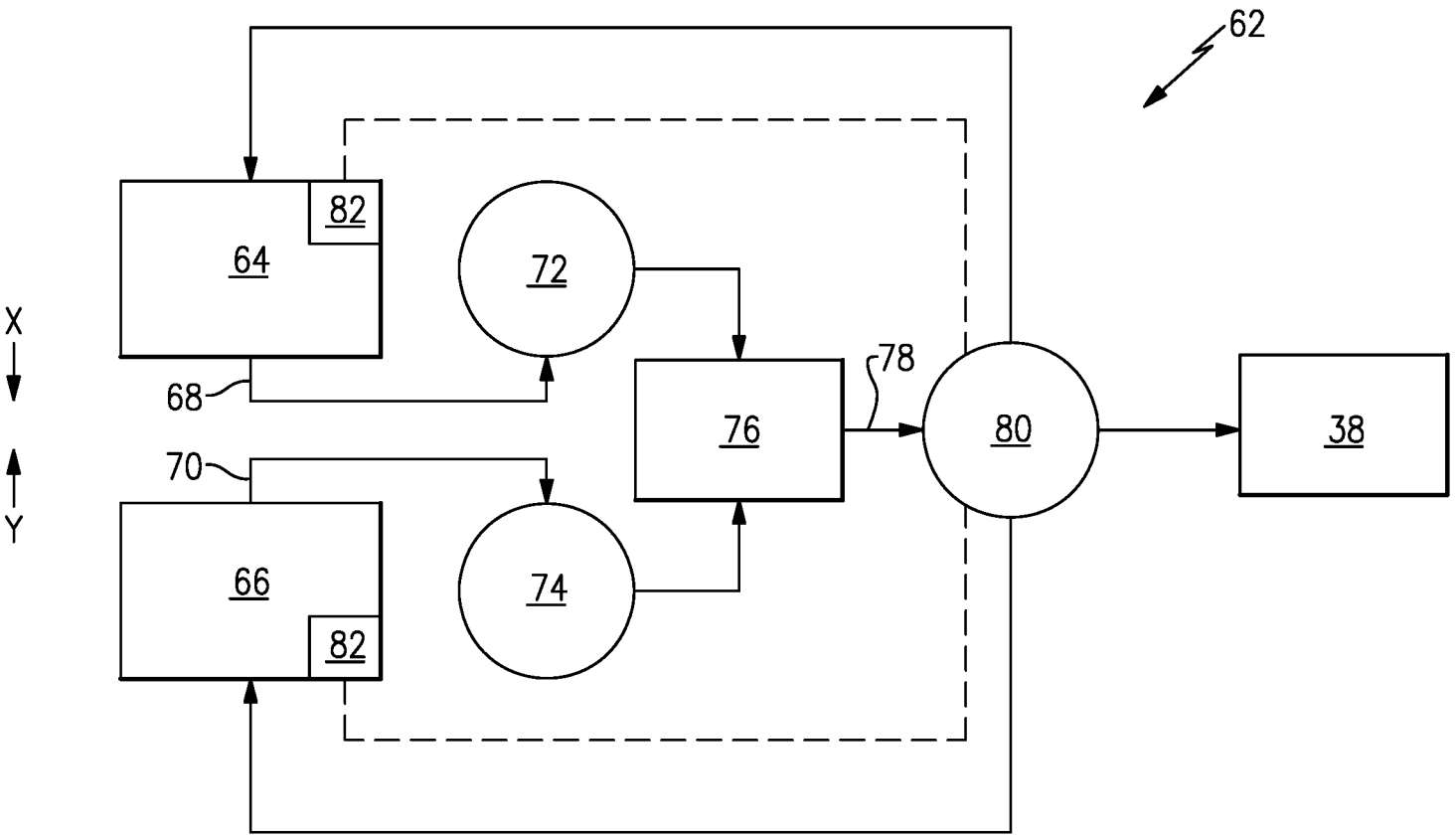
FIG. 2 illustrates a lubrication system.

As shown in FIG. 2, the gas turbine engine 20 includes a lubrication system 62 that lubricates the bearing system 38. In one example, the lubrication system 62 lubricates the fan journal bearings 38*a*. The lubrication system 62 provides a constant and uninterrupted supply of lubricant. In one example, the lubricant is oil. The lubrication system 62 does not depend on gravity or valves for operation. The lubrication system 62 is also tolerant of debris and can operate autonomously.

The lubrication system 62 includes a first reservoir 64 and a second reservoir 66 that each contain the lubricant. At least one of the reservoirs 64 and 66 continuously supplies the lubricant to the bearing system 38 under any operating condition.

The first reservoir 64 includes a first discharge passage 68 that directs the lubricant to flow from the first reservoir 64 in a first direction X. In this example, the direction X is generally downwardly. The second reservoir 66 includes a second discharge passage 70 that directs the lubricant to flow from the second reservoir 66 in a second direction Y. In this example, the direction Y is generally upwardly. In this example, the direction X is opposite to the direction Y.

The lubricant in the discharge passage 68 flows to a first pump 72, and the lubricant in the second discharge passage 70 flows to a second pump 74. The pumps 72 and 74 are each sized so that the individual output of each of the pumps 72 and 74 or the combined output of the pumps 72 and 74 exceed the lubrication or cooling requirements of the bearing system 38. Although two reservoirs 64 and 66 and two pumps 72 and 84 are illustrated and described, any number of reservoirs and pumps can be employed in the lubrication system 62.

The first pump 72 and the second pump 74 supply the lubricant to a common manifold 76 through the discharge passages 68 and 70, respectively. The lubricant is discharged from the common manifold 76 through a common discharge 78 and ultimately to the bearing system 62. As the flow of the lubricant through the discharge passages 68 and 70 are in generally opposing directions, there is a constant and uninterrupted supply of lubricant in case of a sudden change in altitude of the aircraft or if the aircraft encounters an air pocket.

For example, if the aircraft suddenly drops, the lubricant in the reservoirs 64 and 66 moves towards the upper portion of the reservoirs 64 and 66. This could interrupt the flow of lubricant through the discharge passage 68 that directs the lubricant downwardly. However, as the discharge passage 70 directs the lubricant upwardly, the lubricant can continue to flow in an uninterrupted manner through the discharge passage 70.

In another example, if the aircraft suddenly rises, the lubricant in the reservoirs 64 and 66 moves towards the lower portion of the reservoirs 64 and 66. This could interrupt the flow of lubricant through the discharge passage 70 that directs the lubricant upwardly. However, as the discharge passage 68 directs the lubricant downwardly, the lubricant can continue to flow in an uninterrupted manner through the discharge passage 68.

In one example, the lubricant flows directly from the common discharge 78 of the common manifold 76 to the bearing system 38.

In another example, the lubricant flows from the common discharge 78 of the common manifold 76 to a valve 80. The valve 80 directs the flow of the lubricant to the bearing system 38 and the reservoirs 64 and 66 as needed.

In one example, the valve 80 is a relief valve, which is passive valve. The valve 80 directs the lubricant to the bearing system 38 and returns any excess lubricant to replenish the first reservoir 64 and the second reservoir 66.

If one of the reservoirs 64 and 66 is empty, the discharge pressure of the lubricant system 62 drops, closing the valve 80. The pumps 72 and 74 continue to operate, and the pump 72 and 74 associated with the depleted reservoir 64 and 66 pumps air because the lubricant is depleted (for example, because of altitude or gravity vector location, etc.). Initially, the flow of the lubricant from the full reservoir 64 and 66 creates a seal at the valve 80 that blocks the flow of air from the empty reservoir 64 and 66 into the valve 80. The lubricant from the reservoir 64 and 66 is pumped to the valve 80, which directs the lubricant to the reservoir 64 and 66 that is empty. When both the reservoirs 64 and 66 are filled with the lubricant, the lubrication system 62 returns to its initial state. The valve 80 can then be opened by pressure.

In another example, the valve 80 is a control valve, which is an active valve. Each of the reservoirs 64 and 66 includes a sensor 82 that detects an amount of the lubricant in each of the reservoirs 64 and 66. This information is provided to the valve 80. Based on the information obtained by the sensors 82, the valve 80 can be opened to return the excess lubricant to the reservoir 64 and 66 with the depleted lubricant.

In another example, the reservoirs 64 and 66 are in direct communication with each other. In this example, the reservoirs 64 and 66 can supply lubricant to each other when needed to prevent depletion of the lubricant in either of the reservoirs 64 and 66.

Although a gas turbine engine 20 with geared architecture 48 is described, the lubrication system 62 can be employed in a gas turbine engine without geared architecture.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A lubrication system for use with a gas turbine engine comprising:

a first reservoir for containing a lubricant, wherein the first reservoir includes a first discharge passage through which the lubricant is flowable in a first direction;

a second reservoir for containing the lubricant, wherein the second reservoir includes a second discharge passage through which the lubricant is flowable in a second direction, wherein the first direction is generally opposite to the second direction;

a first pump that pumps the lubricant from the first reservoir;

a second pump that pumps the lubricant from the second reservoir; and a manifold to distribute a constant and uninterrupted supply of the lubricant to a bearing, wherein the lubricant from the first pump and the second pump flows into the manifold to combine into a common flow, and the common flow exits the manifold through a common manifold discharge;

a valve, wherein the lubricant flows from the common manifold discharge of the manifold to an input of the valve, the valve including a first output fluidly connected to the bearing, a second output, and a third output;

a third discharge passage bypassing the bearing and fluidly connecting the second output to the first reservoir; and a fourth discharge passage bypassing the bearing and fluidly connecting the third output to the second reservoir.

2. The lubrication system as recited in claim 1 wherein the bearing is a fan journal bearing of a gas turbine engine.

3. The lubrication system as recited in claim 1 wherein the first direction is substantially upwardly and the second direction is substantially downwardly.

4. The lubrication system as recited in claim 1 wherein a respective lubricant output volume of each of the first pump and the second pump is greater than a lubrication requirement of the bearing.

5. The lubrication system as recited in claim 1 wherein the valve is a relief valve.

6. The lubrication system as recited in claim 5 wherein the valve directs a portion of the lubricant to the bearing and a remainder of the lubricant to at least one of the third discharge passage and the fourth discharge passage.

7. The lubrication system as recited in claim 5 wherein the valve closes if one of the first reservoir or the second reservoir is empty.

8. The lubrication system as recited in claim 1 wherein the valve is a control valve, and the lubrication system includes a sensor associated with each of the first reservoir and the second reservoir that detects an amount of the lubricant in each of the first reservoir and the second reservoir, and the control valve directs the lubricant to the one of the third discharge passage and the fourth discharge passage if one of the sensors detects that the one of the first reservoir and the second reservoir is depleted of the lubricant.

9. The lubrication system as recited in claim 1 wherein at least one of the first reservoir and the second reservoir continuously supplies the lubricant to the bearing.

10. The lubrication system as recited in claim 1 wherein, if the lubricant moves upwardly because of a change in altitude, a majority of the lubricant flows through the second discharge passage to the manifold, and if the lubricant moves downwardly because of the change in altitude, a majority of the lubricant flows through the first discharge passage to the manifold.

11. The lubrication system of claim 10, wherein:

the first discharge passage connects to a lower portion of the first reservoir; and the second discharge passage connects to an upper portion of the second reservoir.

* * * * *